US009296588B2

(12) United States Patent
Christy et al.

(10) Patent No.: US 9,296,588 B2
(45) Date of Patent: Mar. 29, 2016

(54) BEST GROUP SELECTION IN ELEVATOR DISPATCHING SYSTEM INCORPORATING REDIRECTOR INFORMATION

(75) Inventors: Theresa Christy, West Hartford, CT (US); Wade Montague, Southington, CT (US); Jannah Stanley, Portland, CT (US); Daniel Williams, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 741 days.

(21) Appl. No.: 13/579,668

(22) PCT Filed: Feb. 19, 2010

(86) PCT No.: PCT/US2010/024701

§ 371 (c)(1), (2), (4) Date: Aug. 17, 2012

(87) PCT Pub. No.: WO2011/102837

PCT Pub. Date: Aug. 25, 2011

(65) Prior Publication Data

US 2013/0168190 A1 Jul. 4, 2013

(51) Int. Cl.

*B66B 1/18* (2006.01)
*B66B 1/06* (2006.01)
*B66B 1/24* (2006.01)

(52) U.S. Cl.

CPC ..... *B66B 1/06* (2013.01); *B66B 1/2408* (2013.01); *B66B 1/2458* (2013.01); *B66B 2201/103* (2013.01)

(58) Field of Classification Search

CPC ..... B66B 1/06; B66B 1/2408; B66B 1/2458; B66B 2201/103

USPC ..... 187/247, 380–388, 391, 393

See application file for complete search history.

(56) References Cited

U.S. PATENT DOCUMENTS 4,792,019 A * 12/1988 Bittar et al. ..... 187/385
5,183,981 A * 2/1993 Thangavelu ..... 187/383

(Continued)

FOREIGN PATENT DOCUMENTS

CN 1170693 A 1/1998
CN 1085611 C 5/2002

(Continued)

OTHER PUBLICATIONS

KR Application No. 10-2012-7024017; dated Sep. 23, 2013; 4 pages (Translation).

(Continued)

*Primary Examiner* — Anthony Salata
(74) *Attorney, Agent, or Firm* — Cantor Colburn LLP

(57) ABSTRACT

An elevator dispatching system includes a plurality of elevator groups, each of the plurality of elevator groups including a group controller and a plurality of elevator cars, each of the plurality of elevator groups serving a respective set of floors; and a redirector configured to receive a service request including a destination floor, and, in the event more than one elevator group serves the destination floor, determine a best group to service the request from the plurality of elevator groups based on information stored in the redirector, wherein the group controller of the determined best group is configured to determine a best car from the plurality of elevator cars in the determined best group.

18 Claims, 3 Drawing Sheets

(56) References Cited

U.S. PATENT DOCUMENTS

| | | | | |
|---|---|---|---|---|
| 5,306,878 | A | 4/1994 | Kubo | |
| 5,511,634 | A * | 4/1996 | Bahjat et al. | 187/383 |
| 5,831,226 | A * | 11/1998 | Hattori et al. | 187/382 |
| 6,065,570 | A * | 5/2000 | Friedli et al. | 187/387 |
| 6,237,721 | B1 * | 5/2001 | Siikonen | 187/382 |
| 6,601,678 | B2 * | 8/2003 | Kostka et al. | 187/383 |
| 6,991,068 | B2 * | 1/2006 | Siikonen et al. | 187/383 |
| 7,117,980 | B2 * | 10/2006 | Wyss | B66B 1/18 187/247 |
| 7,128,190 | B2 * | 10/2006 | Kostka et al. | 187/383 |
| 7,281,610 | B2 | 10/2007 | Ylinen et al. | |
| 7,328,775 | B2 * | 2/2008 | Zaharia et al. | 187/396 |
| 7,416,057 | B2 * | 8/2008 | Kostka | 187/382 |
| 7,490,698 | B2 * | 2/2009 | Sirag, Jr. | 187/381 |
| 8,387,757 | B2 * | 3/2013 | Christy et al. | 187/387 |
| 2012/0325589 | A1 * | 12/2012 | Christy | B66B 1/2408 187/247 |

FOREIGN PATENT DOCUMENTS

| | | | |
|---|---|---|---|
| CN | 1393388 | A | 1/2003 |
| CN | 101565139 | A | 10/2009 |
| JP | S62218374 | A | 9/1987 |
| JP | 4-75978 | A | 3/1992 |
| JP | H04750978 | A | 3/1992 |
| JP | 5-162930 | A | 6/1993 |
| JP | 08085682 | | 4/1996 |
| JP | 2000-272851 | A | 10/2000 |
| JP | 2009263037 | A | 11/2009 |
| KR | 19960010492 | A | 4/1996 |
| KR | 1997074618 | A | 12/1997 |
| KR | 100430230 | | 9/2004 |
| KR | 100498552 | B1 | 2/2006 |
| KR | 1020000001604 | | 2/2006 |
| KR | 20060127914 | A | 12/2006 |
| KR | 1020060127914 | | 12/2006 |
| WO | WO2011/102837 | A1 | 8/2011 |

OTHER PUBLICATIONS

Chinese Office Action dated Dec. 19, 2013 for Application No. 201080064078.X (PCT/US2010/024701); Applicant Name: Otis Elevator Company; (Translation including cover letter); 14 pages.

Chinese Search Report dated Dec. 9, 2013—Application No. 201080064078.X filing date Feb. 19, 2010; Applicant: Otis Elevator Company; 2 pages.

Chinese Search Report dated Feb. 13, 2015 for Application No. 201080064078.X, Filing Date: Feb. 19, 2010; pp. 1-2.

Text of Third Chinese Office Action dated Febrauary 28, 2015 for Application No. 201080064078.X; Application Filing Date Feb. 19, 2010; Applicant: Otis Elevator Company (translation) Part 1: pp. 1-3; Part 2: pp. 1-18.

Abstract_KR100430230.

Abstract_KR1020000001604.

English Equivalent_KR1020060127914.

International Search Report and Written Opinion for International Application No. PCT/US2010/024701; International Filing Date Feb. 19, 2010 mailed on Nov. 18, 2010; 5 pages.

Chinese Second Office Action dated Aug. 26, 2014 for Application No. 201080064078.X; Application Filing Date Feb. 19, 2010; Applicant: Otis Elevator Company (translation) Part 1—pp. 1-3 and Part 2—pp. 1-18.

Japanese Office Action (Translation) dated Aug. 5, 2014 for 2012-553866; pp. 1-2.

International Search Report and Written Opinion for International Application No. PCT/US2010/024701, dated Nov. 18, 2010; 5 pages.

Japanese Office Action (Translation) dated Nov. 28, 2013 for Application No. 2012-553866; 5 pages.

* cited by examiner

BEST GROUP SELECTION IN ELEVATOR DISPATCHING SYSTEM INCORPORATING REDIRECTOR INFORMATION

CROSS-REFERENCE TO RELATED APPLICATION

This is a U.S. national stage of application No. PCT/US2010/024701, filed on 19 Feb. 2010. Priority under 35 U.S.C. §119(a) and 35 U.S.C. §365(b) is claimed, and all the benefits accruing therefrom under 35 U.S.C. §119, the contents of which in its entirety are herein incorporated by reference.

FIELD OF INVENTION

The subject matter disclosed herein generally to the field of elevator dispatching systems.

DESCRIPTION OF RELATED ART

An elevator system may comprise a plurality of elevator groups, each group servicing a set of floors. In such a system, a passenger may select an elevator group from which to request service based on his or her destination. Some destination floors may be serviced by more than one elevator group. If more than one elevator group serves the destination, the passenger may select an elevator group based on factors such as physical location of the elevator group or lobby crowding. After the passenger has selected an elevator group, he or she may enter a service request. Upon receipt of the service request, a group controller associated with the selected group may evaluate each car in the selected group to determine which car in the group should be assigned to service the passenger. The best car for servicing the request may be selected by the group controller using a set of defined criteria, and the selected best car may be assigned to service the request. However, the group controller may only choose among cars in its particular elevator group. Because the elevator group has already been selected by the passenger, and group information is the same for each car in a group, group information is not a factor when choosing the best car.

BRIEF SUMMARY

According to one aspect of the invention, an elevator dispatching system includes a plurality of elevator groups each of the plurality of elevator groups comprising a group controller and a plurality of elevator cars, each of the plurality of elevator groups serving a respective set of floors; and a redirector configured to receive a service request comprising a destination floor, and, in the event more than one elevator group serves the destination floor, determine a best group to service the request from the plurality of elevator groups based on information stored in the redirector, wherein the group controller of the determined best group is configured to determine a best car from the plurality of elevator cars in the determined best group.

According to another aspect of the invention, a method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors includes receiving a service request comprising a destination floor by a redirector; in the event more than one elevator group serves the destination floor, determining a best group of the plurality of elevator groups by the redirector based on information stored in the redirector; determining a best car of the determined best group by the group controller of the determined best group; and assigning the service request to the best car in the determined best group.

According to yet another aspect of the invention, a computer program product comprising a computer readable storage medium containing computer code that, when executed by a computer, implements a method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, wherein the method includes receiving a service request comprising a destination floor by a redirector; in the event more than one elevator group serves the destination floor, determining a best group of the plurality of elevator groups by the redirector based on information stored in the redirector; determining a best car of the determined best group by the group controller of the determined best group; and assigning the service request to the best car in the determined best group.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

Embodiments of systems and methods for best group selection in an elevator dispatching system incorporating redirector information are provided, with exemplary embodiments being discussed below in detail. An elevator dispatching system may comprise one or more global destination entry devices, allowing a passenger to enter a service request without first selecting a specific elevator group in a multi-group elevator system. The elevator dispatching system may then select the best group to service the request. In order to balance traffic between elevator groups, and avoid sending passengers to a crowded elevator group if there exists a less crowded elevator group capable of servicing the request, group information for each elevator group capable of servicing the request may be evaluated to determine the best group. The best group may be selected based on information stored in the redirector. Once the best group is selected, a best car may be selected from the best group.

Directing traffic to a less crowded elevator group when more than one elevator group is capable of fulfilling a service request may reduce crowding and balance traffic among multiple elevator groups. Passengers may experience less crowded lobby and car conditions, and building owners may enjoy reduced lobby queuing, as lobby queuing is a visible problem that is an informal measure of an elevator system's perceived performance.

Figure 1:
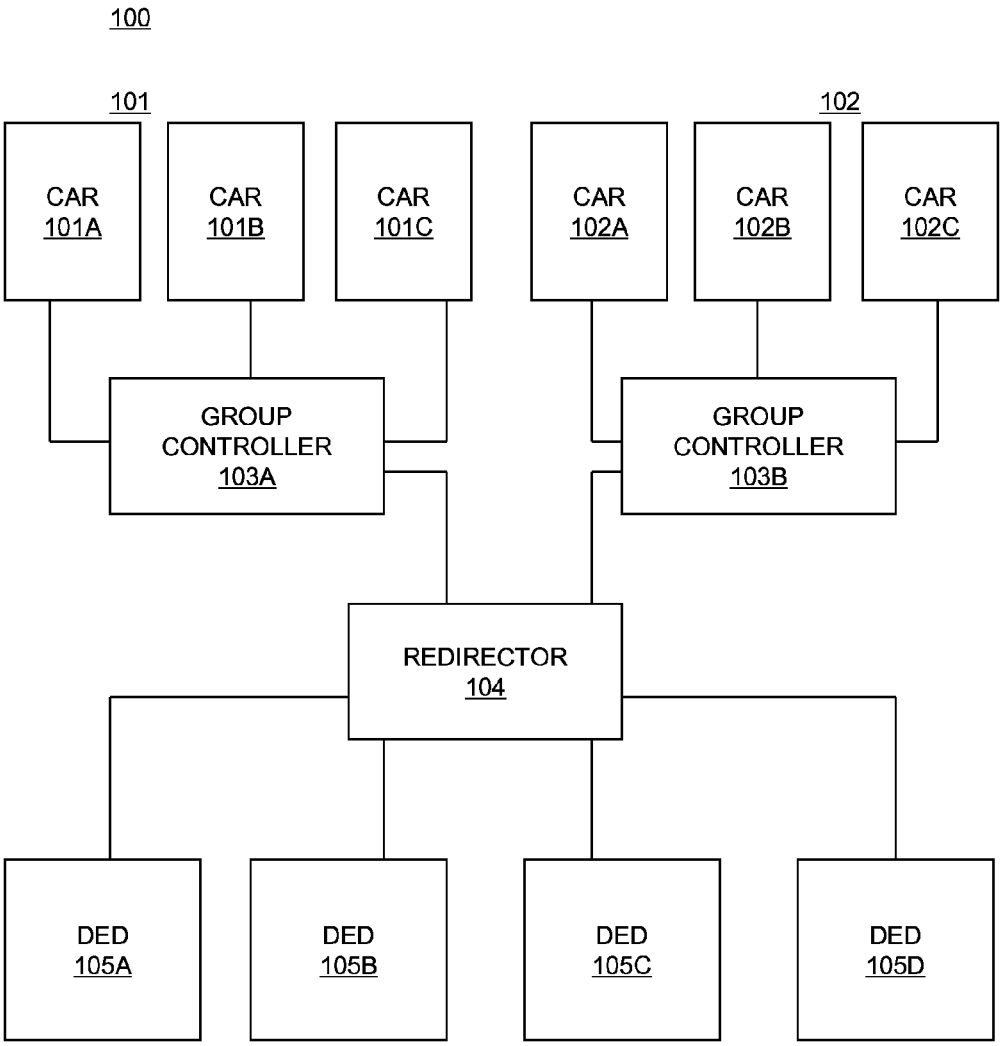
FIG. 1 illustrates an embodiment of an elevator dispatching system.

An embodiment of an elevator dispatching system 100 is shown in FIG. 1. Cars 101*a-c* comprise a first elevator group 101, and are controlled by controller 103*a*. Cars 102*a-c* comprise a second elevator group 102, and are controlled by controller 103*b*. Controllers 103*a-b* are connected to redirector 104. Controllers 103*a-b* may be located in any appropriate physical location in elevator dispatching system 100, such as in one of the individual cars of a controller's respective group. Passengers may input service requests into one of destination entry devices (DEDs) 105*a-d* by entering a floor value for their destination. The service requests are processed by the redirector 104 to first determine a best elevator group to service the request using information stored in the redirector. After the best group is determined by the redirector 104, a best car within the best group is determined by the group controller of the best group. One of DEDs 105*a-d* that was used by the passenger to input the request indicates the selected best group and best car to the passenger. Elevator groups 101 and 102, cars 101*a-c* and 102*a-c*, controllers 103*a-b*, and DEDs 105*a-d* are shown for illustrative purposes only; an elevator dispatching system may comprise any appropriate number of elevator groups, cars, controllers, and DEDs. An elevator group, such as elevator groups 101 and 102, may service any subset of floors in a building, and one or more floors of the system may be serviced by more than one elevator group. Group selection may be performed by a group selection module located in redirector 104.

Figure 2:
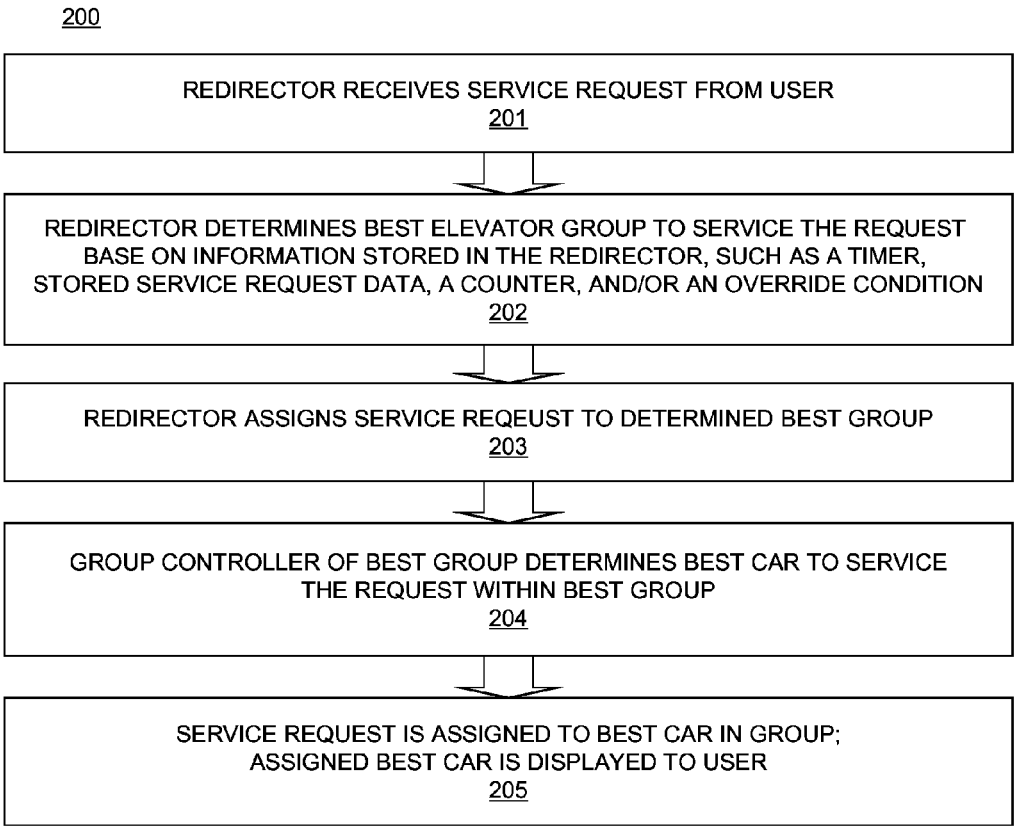
FIG. 2 illustrates an embodiment of a method for best group selection in an elevator dispatching system using redirector information.

FIG. 2 illustrates an embodiment of a method for best group selection that may be embodied in a group selection module in a redirector. FIG. 2 is discussed with reference to FIG. 1. In block 201, redirector 104 receives a service request comprising a destination floor from one of DEDs 105*a-d*. In block 202, the redirector 104 determines a best group to service the request. The best group may be determined by the redirector 104 without input from the group controllers 103*a-b*.

Redirector 104 may consider data stored at the redirector 104 to determine the best group, including but not limited to stored service request data for a particular time of day, a count of service requests assigned to a specific group, a percentage of total service requests received in a specific time period that have been assigned to a specific group, or a percentage of expected service requests to be received in a specific time period that are assigned to a specific group. For example, all destination requests to floors served by two particular groups may be allocated to only one of the groups during the 8 AM-9 AM time period, because it is known that the other group is typically busy with local traffic at that time.

The data used to determine the best group may be configurable by a system administrator. For example, it may be configurable whether to use time of day for selecting the best group. If time of day is used, then the specific time periods may also be configurable. The information used by the redirector 104 to select a best group for a new service request may be combined in various ways including weighted parameters, fuzzy logic, weighted averages or any other evaluation of the available information.

Exemplary embodiments of methods for determining the best group are discussed below with respect to Tables 1-4. The embodiments illustrated in Tables 1-4 do not require any information from the group controller(s). For each of the examples illustrated in Tables 1-4 below, referring to FIG. 1, group 101 is a 3 car (101*a-c*) low-rise group serving the lobby and floors 1-10. Group 102 is a 3 car (102*a-c*) high-rise group serving the lobby, floor 5, and floors 10-18. Floor 5 is a cafeteria floor; during certain times of the day a large proportion of traffic is going to this floor. The goal is to balance traffic between groups 101 and 102.

In some embodiments, the redirector 104 may balance traffic by alternating group assignments for destination requests that may be served by more than one group; an example of this approach is illustrated in Table 1.

TABLE 1

Alternate Group Selection

| Arrival Time | Destination | Group Assignment | Comment |
|---|---|---|---|
| 12:10:03 | 5 | 101 | First Assignment |
| 12:10:05 | 12 | 102 | Only group 102 serves floor 12 |
| 12:10:09 | 10 | 102 | Previous call to destinations serviced by both groups 101 and 102 went to group 101 |
| 12:10:15 | 5 | 101 | Previous call to destinations service by both groups 101 and 102 went to group 102 |
| 12:10:21 | 10 | 102 | Previous call to destinations service by both groups 101 and 102 went to group 101 |

In some embodiments, multiple consecutive requests for the same destination received within a configurable time period may be assigned to the same group by redirector 104. An example of this approach is illustrated in Table 2.

TABLE 2

Elapsed Time Method, Elapsed time period is 10 seconds

| Arrival Time | Destination | Group Assignment | Comment |
|---|---|---|---|
| 12:10:03 | 5 | 101 | First Assignment |
| 12:10:05 | 12 | 102 | Only group 102 serves floor 12 |
| 12:10:09 | 5 | 101 | Request received within 10 seconds of a previous request for the same destination |
| 12:10:15 | 5 | 101 | Request received within 10 seconds of a previous request for the same destination |
| 12:10:21 | 5 | 101 | Request received within 10 seconds of a previous request for the same destination |
| 12:10:40 | 5 | 102 | Request was not received within 10 seconds of a previous for the same destination, therefore assigned to alternate group |

In some embodiments, redirector 104 alternates the best group selection based on a configurable time period, as illustrated in Table 3. There may be separate timers for each floor that is serviced by multiple elevator groups; there may also be a different time periods for different groups.

TABLE 3

Configurable time period is 20 seconds

| Arrival Time | Destination | Group Assignment | Comment |
|---|---|---|---|
| 12:10:00 | | | Configurable time period starts |
| 12:10:03 | 5 | 101 | Within first time period, assign to group 101 |
| 12:10:05 | 12 | 102 | Only group 102 serves floor 12 |
| 12:10:09 | 10 | 101 | Within first time period, assign to group 101 |

TABLE 3-continued

| Configurable time period is 20 seconds | | | |
|---|---|---|---|
| Arrival Time | Destination | Group Assignment | Comment |
| 12:10:15 | 5 | 101 | Within first time period, assign to group 101 |
| 12:10:21 | 10 | 102 | First time period has elapsed, during second time period assign to group 102 |
| 12:10:38 | 5 | 102 | During second time period assign to group 102 |

In some embodiments, redirector 104 may keep a count of requests assigned to each group, and when a threshold number of requests assigned to one group has been reached, the redirector 104 may assign a next request to another group. This method may be used in conjunction with a timer; when a configurable time period expires, the group to which requests are assigned may alternate. An example of this method is illustrated in Table 4.

TABLE 4

| Configurable time period is 15 seconds, threshold is 3 passengers | | | |
|---|---|---|---|
| Arrival Time | Destination | Group Assignment | Comment |
| 12:10:03 | 4 | 101 | Only group 101 serves floor 4; group 101 has 1 passenger |
| 12:10:04 | 5 | 101 | Group 101 has 2 passengers |
| 12:10:04 | 12 | 102 | Only group 102 serves floor 12, group 102 has one passenger |
| 12:10:05 | 5 | 101 | Group 101 has 3 passengers |
| 12:10:06 | 5 | 102 | Group 101 has more than 3 passenger requests in 15 seconds, send to group 102 |

The methods shown in Tables 1-4 are shown for illustrative purposes only; the redirector 104 may use any appropriate algorithm to determine the best group. Any of the methods shown in Tables 1-4 may be used in conjunction with one another, or in conjunction with other methods. The method in use by redirector 104 may change based on various factors, including but not limited to a relatively large number of requests in a particular time period, or the time of day.

The redirector 104 may also consider the physical configuration of the various elevator groups, e.g. the number of cars in the group, the number of floors served by the group, the number of cars in the group serving a floor that is served by multiple groups, the number of groups serving a particular floor, as part of its evaluation of best group. This information is static and may be stored at the redirector 104 for best group selection purposes. The static data that the redirector 104 uses may change based on circumstances. For example, if a car belonging to a group is out of service, that information may be reflected in the data stored in the redirector 104. The redirector 104 may then change the stored number of cars for the group until a communication is received that the car is back in service.

The redirector 104 may also consider override conditions, which may cause one group to be chosen over another even if their respective group scores indicate a different choice. Override conditions may include: a specific elevator group may already have a waiting passenger going from the same origin and to the same destination as the service request, or a specific group may already have a waiting passenger going from the same origin as the service request. The distance from the DED at which the service request was entered to the furthest car in each group may also be considered; passengers with disabilities may cause the redirector to allocate their service request to the closest group capable of servicing the request as measured by the distance from the particular DED.

Returning to FIG. 2, in block 203, the service request is assigned to the best group determined by the redirector 104 in block 202. In block 204, a best car from the determined best group is determined by the group controller of the best group. In block 205, the passenger is assigned to the determined best group and best car; the assignment may be indicated to the passenger via one of DEDs 105*a-d*.

Figure 3:
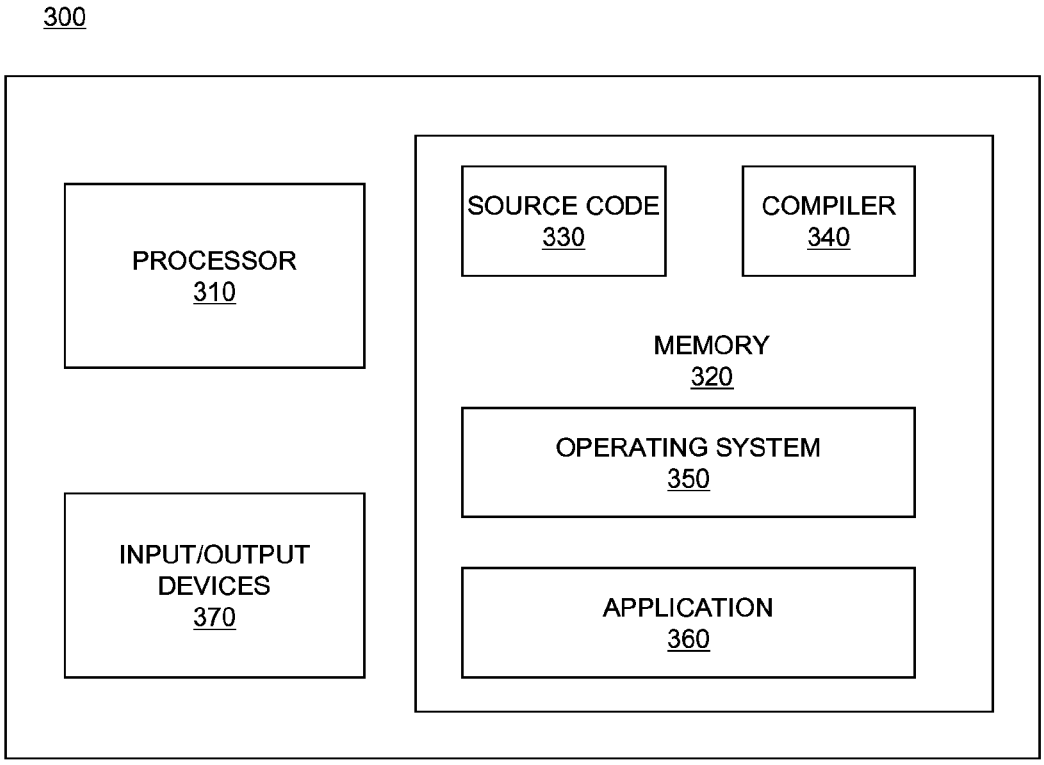
FIG. 3 illustrates an embodiment of a computer that may be used in conjunction with embodiments systems and methods for best group selection in an elevator dispatching system using redirector information.

FIG. 3 illustrates an example of a computer 300 which may be utilized by exemplary embodiments of systems and methods for best group selection using redirector information in an elevator dispatching system as embodied in software. Various operations discussed above may utilize the capabilities of the computer 300. One or more of the capabilities of the computer 300 may be incorporated in any element, module, application, and/or component discussed herein.

The computer 300 includes, but is not limited to, PCs, workstations, laptops, PDAs, palm devices, servers, storages, and the like. Generally, in terms of hardware architecture, the computer 300 may include one or more processors 310, memory 320, and one or more input and/or output (I/O) devices 370 that are communicatively coupled via a local interface (not shown). The local interface can be, for example but not limited to, one or more buses or other wired or wireless connections, as is known in the art. The local interface may have additional elements, such as controllers, buffers (caches), drivers, repeaters, and receivers, to enable communications. Further, the local interface may include address, control, and/or data connections to enable appropriate communications among the aforementioned components.

The processor 310 is a hardware device for executing software that can be stored in the memory 320. The processor 310 can be virtually any custom made or commercially available processor, a central processing unit (CPU), a digital signal processor (DSP), or an auxiliary processor among several processors associated with the computer 300, and the processor 310 may be a semiconductor based microprocessor (in the form of a microchip) or a macroprocessor.

The memory 320 can include any one or combination of volatile memory elements (e.g., random access memory (RAM), such as dynamic random access memory (DRAM), static random access memory (SRAM), etc.) and nonvolatile memory elements (e.g., ROM, erasable programmable read only memory (EPROM), electronically erasable programmable read only memory (EEPROM), programmable read only memory (PROM), tape, compact disc read only memory (CD-ROM), disk, diskette, cartridge, cassette or the like, etc.). Moreover, the memory 320 may incorporate electronic, magnetic, optical, and/or other types of storage media. Note that the memory 320 can have a distributed architecture, where various components are situated remote from one another, but can be accessed by the processor 310.

The software in the memory 320 may include one or more separate programs, each of which comprises an ordered listing of executable instructions for implementing logical functions. The software in the memory 320 may include a suitable operating system (O/S) 350, compiler 340, source code 330, and one or more applications 360 in accordance with exemplary embodiments. As illustrated, the application 360 comprises numerous functional components for implementing the features and operations of the exemplary embodiments. The application 360 of the computer 300 may represent various applications, computational units, logic, functional units, processes, operations, virtual entities, and/or modules in accordance with exemplary embodiments, but the application 360 is not meant to be a limitation.

The operating system 350 controls the execution of other computer programs, and provides scheduling, input-output control, file and data management, memory management, and communication control and related services. It is contemplated by the inventors that the application 360 for implementing exemplary embodiments may be applicable on all commercially available operating systems.

Application 360 may be a source program, executable program (object code), script, or any other entity comprising a set of instructions to be performed. When a source program, then the program is usually translated via a compiler (such as the compiler 340), assembler, interpreter, or the like, which may or may not be included within the memory 320, so as to operate properly in connection with the O/S 350. Furthermore, the application 360 can be written as an object oriented programming language, which has classes of data and methods, or a procedure programming language, which has routines, subroutines, and/or functions, for example but not limited to, C, C++, C#, Pascal, BASIC, API calls, HTML, XHTML, XML, ASP scripts, FORTRAN, COBOL, Perl, Java, ADA, .NET, and the like.

The I/O devices 370 may include input devices such as, for example but not limited to, a mouse, keyboard, scanner, microphone, camera, etc. Furthermore, the I/O devices 370 may also include output devices, for example but not limited to a printer, display, etc. Finally, the I/O devices 370 may further include devices that communicate both inputs and outputs, for instance but not limited to, a NIC or modulator/demodulator (for accessing remote devices, other files, devices, systems, or a network), a radio frequency (RF) or other transceiver, a telephonic interface, a bridge, a router, etc. The I/O devices 370 also include components for communicating over various networks, such as the Internet or intranet.

If the computer 300 is a PC, workstation, intelligent device or the like, the software in the memory 320 may further include a basic input output system (BIOS) (omitted for simplicity). The BIOS is a set of essential software routines that initialize and test hardware at startup, start the O/S 350, and support the transfer of data among the hardware devices. The BIOS is stored in some type of read-only-memory, such as ROM, PROM, EPROM, EEPROM or the like, so that the BIOS can be executed when the computer 300 is activated.

When the computer 300 is in operation, the processor 310 is configured to execute software stored within the memory 320, to communicate data to and from the memory 320, and to generally control operations of the computer 300 pursuant to the software. The application 360 and the O/S 350 are read, in whole or in part, by the processor 310, perhaps buffered within the processor 310, and then executed.

When the application 360 is implemented in software it should be noted that the application 360 can be stored on virtually any computer readable medium for use by or in connection with any computer related system or method. In the context of this document, a computer readable medium may be an electronic, magnetic, optical, or other physical device or means that can contain or store a computer program for use by or in connection with a computer related system or method.

The application 360 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium.

More specific examples (a nonexhaustive list) of the computer-readable medium may include the following: an electrical connection (electronic) having one or more wires, a portable computer diskette (magnetic or optical), a random access memory (RAM) (electronic), a read-only memory (ROM) (electronic), an erasable programmable read-only memory (EPROM, EEPROM, or Flash memory) (electronic), an optical fiber (optical), and a portable compact disc memory (CDROM, CD R/W) (optical). Note that the computer-readable medium could even be paper or another suitable medium, upon which the program is printed or punched, as the program can be electronically captured, via for instance optical scanning of the paper or other medium, then compiled, interpreted or otherwise processed in a suitable manner if necessary, and then stored in a computer memory.

In exemplary embodiments, where the application 360 is implemented in hardware, the application 360 can be implemented with any one or a combination of the following technologies, which are well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

The technical effects and benefits of exemplary embodiments include reduction of elevator car crowding and lobby queuing.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. An elevator dispatching system, comprising:

a plurality of elevator groups, each of the plurality of elevator groups comprising a group controller and a plurality of elevator cars, each of the plurality of elevator groups serving a respective set of floors; and a redirector configured to receive a service request comprising a destination floor, and, in the event more than one elevator group serves the destination floor, determine a best group to service the request from the plurality of elevator groups based on information stored in the redirector, wherein the group controller of the determined best group is configured to determine a best car from the plurality of elevator cars in the determined best group, wherein the information stored in the redirector comprises a timer, such that the redirector is configured to alternate an elevator group chosen as the best group in the event the timer expires.

2. The elevator dispatching system of claim 1, further comprising at least one destination entry device, the at least one destination entry device configured to receive a service request from a user, send the service request to the redirector, receive the determined best group and best car from the redirector, and display the determined best group and best car to the user.

3. The elevator dispatching system of claim 1, wherein the information stored in the redirector comprises at least one of: stored service request data for a particular time of day, a count of service requests assigned to a specific elevator group, a percentage of total service requests received in a specific time period that have been assigned to a specific elevator group, or a percentage of expected service requests received in a specific time period that are assigned to a specific group.

4. The elevator dispatching system of claim 1, wherein the information stored in the redirector comprises a count of service requests assigned to an elevator group, such that the redirector is configured to alternate an elevator group chosen as the best group in the event the count of service requests exceeds a predetermined threshold.

5. The elevator dispatching system of claim 1, wherein the redirector is configured to determine the best group based on an override condition, the override condition comprising one of: one elevator group of the plurality of elevator groups has a waiting passenger going from the same origin and to the same destination as the service request, one elevator group of the plurality of elevator groups has a waiting passenger going from the same origin as the service request, or a passenger making the service request has a disability.

6. A method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, the method comprising:

receiving a service request comprising a destination floor by a redirector;

in the event more than one elevator group serves the destination floor, determining a best group of the plurality of elevator groups by the redirector based on information stored in the redirector;

determining a best car of the determined best group by the group controller of the determined best group; and assigning the service request to the best car in the determined best group, wherein the information stored in the redirector comprises a timer, such that the redirector is configured to alternate an elevator group chosen as the best group in the event the timer expires.

7. The method of claim 6, further comprising:

receiving a service request from a user at a destination entry device and sending the service request from the destination entry device to the redirector; and receiving the determined best group and best car by the destination entry device from the redirector, and displaying the determined best group and best car to the user by the destination entry device.

8. The method of claim 6, wherein the information stored in the redirector comprises at least one of: stored service request data for a particular time of day, a count of service requests assigned to a specific elevator group, a percentage of total service requests received in a specific time period that have been assigned to a specific elevator group, or a percentage of expected service requests received in a specific time period that are assigned to a specific group.

9. The method of claim 6, wherein the information stored in the redirector comprises a count of service requests assigned to an elevator group, such that the redirector is configured to alternate an elevator group chosen as the best group in the event the count of service requests exceeds a predetermined threshold.

10. The method of claim 6, wherein determining a best group of the plurality of elevator groups by the redirector based on information stored in the redirector is based on an override condition, the override condition comprising one of: one elevator group of the plurality of elevator groups has a waiting passenger going from the same origin and to the same destination as the service request, one elevator group of the plurality of elevator groups has a waiting passenger going from the same origin as the service request, or a passenger making the service request has a disability.

11. A computer program product comprising a computer readable storage medium containing computer code that, when executed by a computer, implements a method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, wherein the method comprises:

receiving a service request comprising a destination floor by a redirector;

in the event more than one elevator group serves the destination floor, determining a best group of the plurality of elevator groups by the redirector based on information stored in the redirector;

determining a best car of the determined best group by the group controller of the determined best group; and assigning the service request to the best car in the determined best group, wherein the information stored in the redirector comprises a timer, such that the redirector is configured to alternate an elevator group chosen as the best group in the event the timer expires.

12. The computer program product according to claim 11, further comprising:

receiving a service request from a user at a destination entry device and sending the service request from the destination entry device to the redirector; and receiving the determined best group and best car by the destination entry device from the redirector, and displaying the determined best group and best car to the user by the destination entry device.

13. The computer program product according to claim 11, wherein the information stored in the redirector comprises at least one of: stored service request data for a particular time of day, a count of service requests assigned to a specific elevator group, a percentage of total service requests received in a specific time period that have been assigned to a specific elevator group, or a percentage of expected service requests received in a specific time period that are assigned to a specific group.

14. The computer program product according to claim 11, wherein the information stored in the redirector comprises a count of service requests assigned to an elevator group, such that the redirector is configured to alternate an elevator group chosen as the best group in the event the count of service requests exceeds a predetermined threshold.

15. The computer program product according to claim 11, wherein determining a best group of the plurality of elevator groups by the redirector based on information stored in the redirector is based on an override condition, the override condition comprising one of: one elevator group of the plurality of elevator groups has a waiting passenger going from the same origin and to the same destination as the service request, one elevator group of the plurality of elevator groups has a waiting passenger going from the same origin as the service request, or the passenger making the service request has a disability.

16. An elevator dispatching system, comprising:

a plurality of elevator groups, each of the plurality of elevator groups comprising a group controller and a plurality of elevator cars, each of the plurality of elevator groups serving a respective set of floors; and a redirector configured to receive a service request comprising a destination floor, and, in the event more than one elevator group serves the destination floor, determine a best group to service the request from the plurality of elevator groups based on information stored in the redirector, wherein the group controller of the determined best group is configured to determine a best car from the plurality of elevator cars in the determined best group, wherein the information stored in the redirector comprises a count of service requests assigned to an elevator group, such that the redirector is configured to alternate an elevator group chosen as the best group in the event the count of service requests exceeds a predetermined threshold.

17. A method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, the method comprising:

receiving a service request comprising a destination floor by a redirector;

in the event more than one elevator group serves the destination floor, determining a best group of the plurality of elevator groups by the redirector based on information stored in the redirector;

determining a best car of the determined best group by the group controller of the determined best group; and assigning the service request to the best car in the determined best group, wherein the information stored in the redirector comprises a count of service requests assigned to an elevator group, such that the redirector is configured to alternate an elevator group chosen as the best group in the event the count of service requests exceeds a predetermined threshold.

18. A computer program product comprising a computer readable storage medium containing computer code that, when executed by a computer, implements a method for best group selection in an elevator dispatching system, the elevator dispatching system comprising a plurality of elevator groups, each of the plurality of elevator groups comprising a group controller and a plurality of elevator cars, each of the plurality of elevator groups serving a respective set of floors, wherein the method comprises:

receiving a service request comprising a destination floor by a redirector;

in the event more than one elevator group serves the destination floor, determining a best group of the plurality of elevator groups by the redirector based on information stored in the redirector;

determining a best car of the determined best group by the group controller of the determined best group; and assigning the service request to the best car in the determined best group, wherein the information stored in the redirector comprises a count of service requests assigned to an elevator group, such that the redirector is configured to alternate an elevator group chosen as the best group in the event the count of service requests exceeds a predetermined threshold.

* * * * *